US012022876B2

(12) United States Patent
Lee et al.

(10) Patent No.: US 12,022,876 B2
(45) Date of Patent: Jul. 2, 2024

(54) AEROSOL GENERATING DEVICE

(71) Applicant: KT&G CORPORATION, Daejeon (KR)

(72) Inventors: Won Kyeong Lee, Guri-si (KR); Jong Sub Lee, Seongnam-si (KR); Min Kyu Kim, Daejeon (KR); Byung Sung Cho, Gwangmyeong-si (KR)

(73) Assignee: KT&G CORPORATION, Daejeon (KR)

( * ) Notice: Subject to any disclaimer, the term of this patent is extended or adjusted under 35 U.S.C. 154(b) by 550 days.

(21) Appl. No.: 17/292,779

(22) PCT Filed: Dec. 14, 2020

(86) PCT No.: PCT/KR2020/018239
§ 371 (c)(1),
(2) Date: May 11, 2021

(87) PCT Pub. No.: WO2021/145568
PCT Pub. Date: Jul. 22, 2021

(65) Prior Publication Data

US 2022/0408831 A1 Dec. 29, 2022

(30) Foreign Application Priority Data

Jan. 16, 2020 (KR) ..... 10-2020-0006166

(51) Int. Cl.
*A24F 40/50* (2020.01)
*A24F 40/10* (2020.01)
*A24F 40/42* (2020.01)

(52) U.S. Cl.
CPC ..... *A24F 40/50* (2020.01); *A24F 40/10* (2020.01); *A24F 40/42* (2020.01)

(58) Field of Classification Search
CPC ..... A24F 40/50; A24F 40/10; A24F 40/42; A24F 40/40; A24F 40/46; A24F 40/53; A24F 40/60
See application file for complete search history.

(56) References Cited

U.S. PATENT DOCUMENTS 10,070,667 B2 9/2018 Lord et al.
10,159,279 B2 12/2018 Lord et al.
(Continued)

FOREIGN PATENT DOCUMENTS

CN 105517456 A 4/2016
CN 108827372 A 11/2018
(Continued)

OTHER PUBLICATIONS

Office Action dated Aug. 23, 2022 issued by the Japanese Patent Office in Japanese Application No. 2021-540454.
(Continued)

*Primary Examiner* — Truc T Nguyen
(74) *Attorney, Agent, or Firm* — Sughrue Mion, PLLC

(57) ABSTRACT

According to some embodiments, an aerosol generating device includes: a main body including an accommodation space into which a cartridge, that is detachable, is configured to be inserted; a battery provided in the main body and configured to supply power to power consumption components included in the main body; a feedback line configured to feedback electrical connection between a heater in the cartridge and the main body based on the cartridge being inserted into the accommodation space; and a controller configured to change a mode of the aerosol generating device to a use mode based on a feedback signal being received through the feedback line when the aerosol generating device is set to a shipping mode.

6 Claims, 8 Drawing Sheets

(56) References Cited

U.S. PATENT DOCUMENTS

| | | | | |
|---|---|---|---|---|
| 10,888,125 | B2 * | 1/2021 | Anderson | H02J 7/0045 |
| 10,905,843 | B2 | 2/2021 | Smith et al. | |
| 2005/0016550 | A1 | 1/2005 | Katase | |
| 2011/0036346 | A1 * | 2/2011 | Cohen | A24F 40/60 128/200.14 |
| 2015/0128975 | A1 * | 5/2015 | Alarcon | H02J 7/0048 131/329 |
| 2016/0206000 | A1 | 7/2016 | Lord et al. | |
| 2017/0233114 | A1 * | 8/2017 | Christensen | B65B 3/14 141/2 |
| 2018/0006482 | A1 | 1/2018 | Jin et al. | |
| 2018/0140009 | A1 | 5/2018 | Sur et al. | |
| 2019/0307177 | A1 | 10/2019 | Maeder et al. | |
| 2019/0387795 | A1 | 12/2019 | Fisher et al. | |
| 2020/0000143 | A1 * | 1/2020 | Anderson | G06F 18/22 |
| 2020/0000146 | A1 * | 1/2020 | Anderson | H01R 13/6205 |
| 2020/0120991 | A1 * | 4/2020 | Hatton | A24F 40/57 |
| 2020/0352246 | A1 | 11/2020 | Yamada et al. | |

FOREIGN PATENT DOCUMENTS

| | | | |
|---|---|---|---|
| CN | 109820249 | A | 5/2019 |
| CN | 110632960 | A | 12/2019 |
| JP | 2016-528910 | A | 9/2016 |
| JP | 2019-505297 | A | 2/2019 |
| JP | 2019-535276 | A | 12/2019 |
| KR | 10-2018-0004388 | A | 1/2018 |
| KR | 10-2018-0059576 | A | 6/2018 |
| KR | 10-1862826 | B1 | 7/2018 |
| KR | 10-2019-0089867 | A | 7/2019 |
| WO | 2019145672 | A1 | 8/2019 |
| WO | 2019146061 | A1 | 8/2019 |

OTHER PUBLICATIONS

Extended European Search Report dated Jan. 10, 2022 from the European Patent Office in EP Application No. 20894941.2.

Office Action issued Apr. 7, 2023 in Chinese Application No. 202080007519.6.

International Search Report issued Jun. 7, 2021 by the International Searching Authority in application No. PCT/KR2020/018239.

* cited by examiner

AEROSOL GENERATING DEVICE

CROSS REFERENCE TO RELATED APPLICATIONS

This application is a National Stage of International Application No. PCT/KR2020/018239 filed Dec. 14, 2020, claiming priority based on Korean Patent Application No. 10-2020-0006166 filed Jan. 16, 2020.

TECHNICAL FIELD

One or more embodiments relate to an aerosol generating device.

BACKGROUND ART

Recently, the demand for alternative methods to overcome the disadvantages of traditional cigarettes has increased. For example, there is growing demand for a system which generates aerosol by heating a cigarette or an aerosol generating material using an aerosol generating device, rather than by combusting cigarettes.

On the other hand, by minimizing the power consumption of a battery after the aerosol generating device is shipped and before it is used by a user, an aerosol generating device can be set to a shipping mode and shipped to increase a stocked time at a shipping destination (e.g. a store) when the aerosol generating device is available to be sold to a user.

SUMMARY

A. Technical Problem

Some aerosol generating devices according to the related art additionally require a cumbersome operation, such as connecting a charging cable to the aerosol generating device, in order to release the shipping mode. In addition, some aerosol generating devices according to the related art are configured to change from the shipping mode to a use mode from the moment the aerosol generating device is removed from its packaging, and accordingly, the power consumption of the battery cannot be minimized before the aerosol generating device is actually used by the user after the aerosol generating device is removed from the packaging.

B. Technical Solution

One or more embodiments of the present disclosure include an aerosol generating device. The technical problems solved by embodiments of the present disclosure are not limited to the above-described technical problems, and other technical problems may be understood from and solved by the embodiments to be described hereinafter.

According to one or more embodiments, an aerosol generating device includes a main body including an accommodation space into which a detachable cartridge is inserted, a battery provided in the main body to supply power to power consumption components included in the main body, a feedback line configured to feedback electrical connection between a heater in the cartridge and the main body as the cartridge is inserted into the accommodation space, and a controller configured to change a mode of the aerosol generating device to a use mode as a feedback signal is received through the feedback line when the aerosol generating device is set to a shipping mode.

C. Advantageous Effects

Embodiments of the present disclosure may provide an aerosol generating device. In detail, the aerosol generating device according to an embodiment of the present disclosure may include a main body including an accommodation space into which a detachable cartridge is inserted, a battery provided in the main body to supply power to power consumption components included in the main body, a feedback line configured to feedback electrical connection between a heater in the cartridge and the main body as the cartridge is inserted into the accommodation space, and a controller configured to change a mode of the aerosol generating device to a use mode as a feedback signal is received through the feedback line when the aerosol generating device is set to a shipping mode.

In order to smoke using the aerosol generating device used together with the detachable cartridge, an operation of inserting the cartridge into the accommodation space of the main body needs to be provided. In this way, in the aerosol generating device according to an embodiment of the present disclosure, the mode of the aerosol generating device may be changed from the shipping mode to the use mode by detecting that the cartridge is inserted into the accommodation space so that the shipping mode may be released by an operation naturally accompanied in a process from purchasing the aerosol generating device to use. Thus, a cumbersome operation such as connecting a charging cable to an aerosol generating device is not additionally required, as in the aerosol generating device according to the related art, so that user convenience may be increased.

Also, since the aerosol generating device according to an embodiment of the present disclosure is switched to the user mode from the point when the cartridge is inserted into the accommodation space, the power consumption of the battery may be minimized regardless of how long a delay between the time the aerosol generating device is removed from a packaging and a time the aerosol generating device is actually used by the user. Also, since the aerosol generating device according to an embodiment of the present disclosure uses the feedback line without using a separate sensor to detect that the cartridge is inserted into the accommodation space, power consumed to detect insertion of the cartridge into the accommodation space may also be reduced.

BEST MODE

Figure 1:
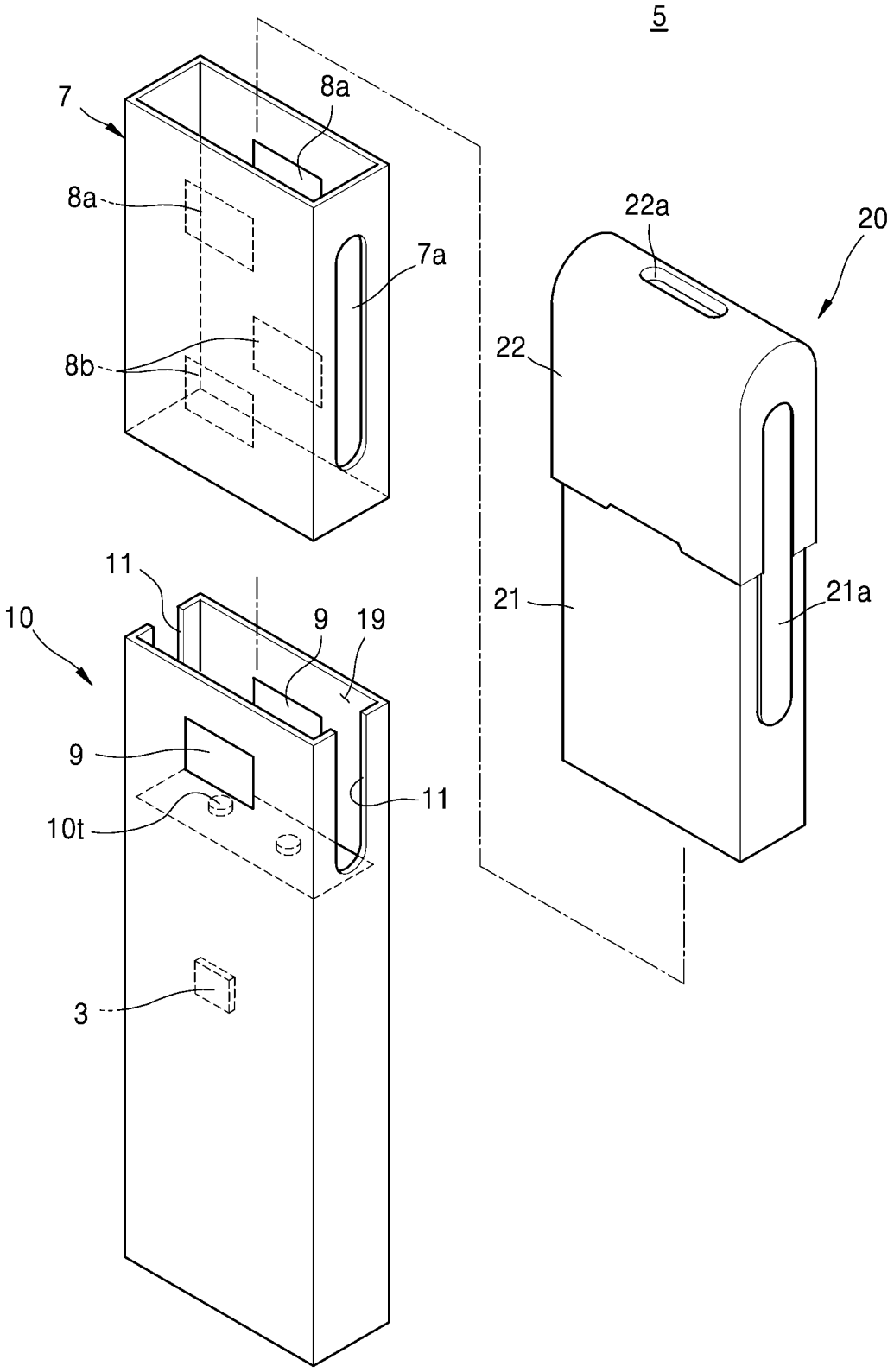
FIG. 1 is an exploded perspective view schematically illustrating a coupling relationship between a replaceable cartridge containing an aerosol generating material and an aerosol generating device including the same, according to an embodiment.

According to one or more embodiments, an aerosol generating device is provided. The aerosol generating device includes: a main body comprising an accommodation space into which a cartridge, that is detachable, is configured to be inserted; a battery provided in the main body and configured to supply power to power consumption components included in the main body; a feedback line configured to feedback electrical connection between a heater in the cartridge and the main body based on the cartridge being inserted into the accommodation space; and a controller configured to change a mode of the aerosol generating device to a use mode based on a feedback signal being received through the feedback line when the aerosol generating device is set to a shipping mode.

According to an embodiment, the controller is further configured to apply an enable signal to at least one low-dropout regulator (LDO) for controlling supply of a voltage or current with respect to the power consumption components, thereby changing the mode of the aerosol generating device to the use mode.

According to an embodiment, the at least one LDO is configured to block electrical connection between the power consumption components, connected to the at least one LDO, and the battery when the aerosol generating device is in the shipping mode.

According to an embodiment, the at least one LDO is configured to electrically connect the power consumption components, connected to the at least one LDO, to the battery when the aerosol generating device is in the use mode.

According to an embodiment, the controller is further configured to maintain the mode of the aerosol generating device as the use mode even if the feedback signal is not received through the feedback line after the aerosol generating device is changed to the use mode.

According to an embodiment, the controller is further configured to cause display of information on a remaining amount of the battery based on, while the aerosol generating device is in the use mode, the feedback signal not being received through the feedback line and then being received again.

According to an embodiment, the use mode includes a sleep mode in which at least some of the power consumption components are maintained in an activated state, and an operation mode in which a preset operation is performed using one or more of the power consumption components or the heater.

According to an embodiment, the power consumption components includes at least one from among a sensor, a user interface, and a memory.

According to an embodiment, the controller is further configured to set the aerosol generating device to the shipping mode based on an external input before the aerosol generating device is shipped.

DETAILED DESCRIPTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meanings of the terms and the descriptions provided herein.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "below," "under," "beneath," "connected to" or "coupled to" another element, it can be directly over, above, on, below, under, beneath, connected or coupled to the other element or intervening elements may be present. In contrast, when an element is referred to as being "directly over," "directly above," "directly on," "directly below," "directly under," "directly beneath," "directly connected to" or "directly coupled to" another element, there are no intervening elements present.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, example embodiments of the present disclosure will now be described more fully with reference to the accompanying drawings such that one of ordinary skill in the art may easily work the present disclosure. Embodiments of the present disclosure may, however, be embodied in many different forms and should not be construed as being limited to the example embodiments set forth herein.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes a cartridge 20, containing the aerosol generating material, and a main body 10 supporting the cartridge 20.

The cartridge 20 may be coupled to the main body 10 in a state in which the aerosol generating material is accommodated therein. A portion of the cartridge 20 is inserted into an accommodation space 19 of the main body 10 so that the cartridge 20 may be mounted on the main body 10.

The cartridge 20 may contain an aerosol generating material in any one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving the electrical signal from the main body 10 and heating the aerosol generating material, or by using an ultrasonic vibration method, or by using an induction heating method. As another example, when the cartridge 20 includes its own power source, the cartridge 20 may generate aerosol by being operated by an electric control signal or a wireless signal transmitted from the main body 10 to the cartridge 20.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element impregnated with (containing) an aerosol generating material, such as a sponge, cotton, fabric, or porous ceramic structure.

The atomizer may include, for example, a liquid delivery element (wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the same in an optimal state for conversion to aerosol without using a separate liquid delivery element, and the function of generating aerosol by heating the aerosol generating material.

At least a portion of the liquid storage 21 of the cartridge 20 may include a transparent material so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and the liquid storage 21 may be entirely formed of transparent plastic or glass, or only the protruding window 21*a* corresponding to a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to an operation of the cartridge 20 to the cartridge 20 through the connection terminal 10*t*.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 to move with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 has a container shape with a hollow space therein and both ends opened. The structure of the slider 7 is not limited to the container shape as shown in the drawing, and the slider 7 may have a bent plate structure having a clip-shaped cross-section, which is movable with respect to the main body 10 while being coupled to an edge of the main body 10, or a structure having a curved semi-cylindrical shape and a curved arc-shaped cross section.

The slider 7 includes a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 therebetween, and two second magnetic bodies 8*b* facing each other with the inner space of the slider 7 therebetween. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes at least one fixed magnetic body 9 arranged on a path along which the first magnetic bodies 8*a* and the second magnetic bodies 8*b* of the slider 7 move while the slider 7 moves with respect to the main body 10. For example, two fixed magnetic bodies 9 of the main body 10 may be mounted to face each other with the accommodation space 19 therebetween.

Depending on the position of the slider 7, the slider 7 may be stably maintained in a position where an end of the mouthpiece 22 is covered or exposed by a magnetic force acting between at least one of the fixed magnetic bodies 9 and at least one of the first magnetic bodies 8*a* or between at least one of the fixed magnetic bodies 9 and at least one of the second magnetic bodies 8*b*.

The main body 10 includes a position change detecting sensor 3 arranged on the path along which one of the first magnetic bodies 8*a* and one of the second magnetic bodies 8*b* of the slider 7 move while the slider 7 moves with respect to the main body 10. The position change detecting sensor 3 may include, for example, a Hall IC using the Hall effect that detects a change in a magnetic field and generates a signal.

In the aerosol generating device 5 according to the above-described embodiments, the main body 10, the cartridge 20, and the slider 7 have approximately rectangular cross-sectional shapes in a direction transverse to the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

Figure 2:
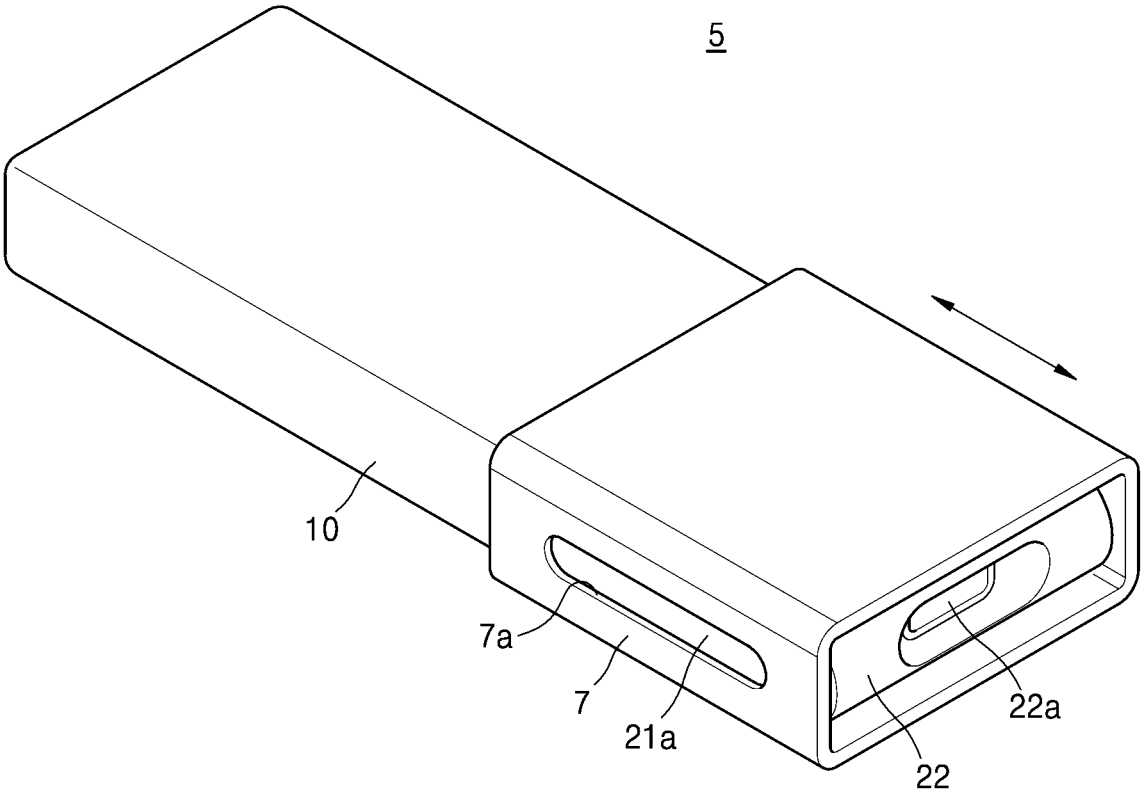
FIG. 2 is a perspective view of an example operating state of the aerosol generating device according to the embodiment illustrated in FIG. 1.

FIG. 2 is a perspective view of an example operating state of the aerosol generating device according to the embodiment illustrated in FIG. 1.

In FIG. 2, the operating state is shown in which the slider 7 is moved to a position where the end of the mouthpiece 22 of the cartridge coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

Figure 3:
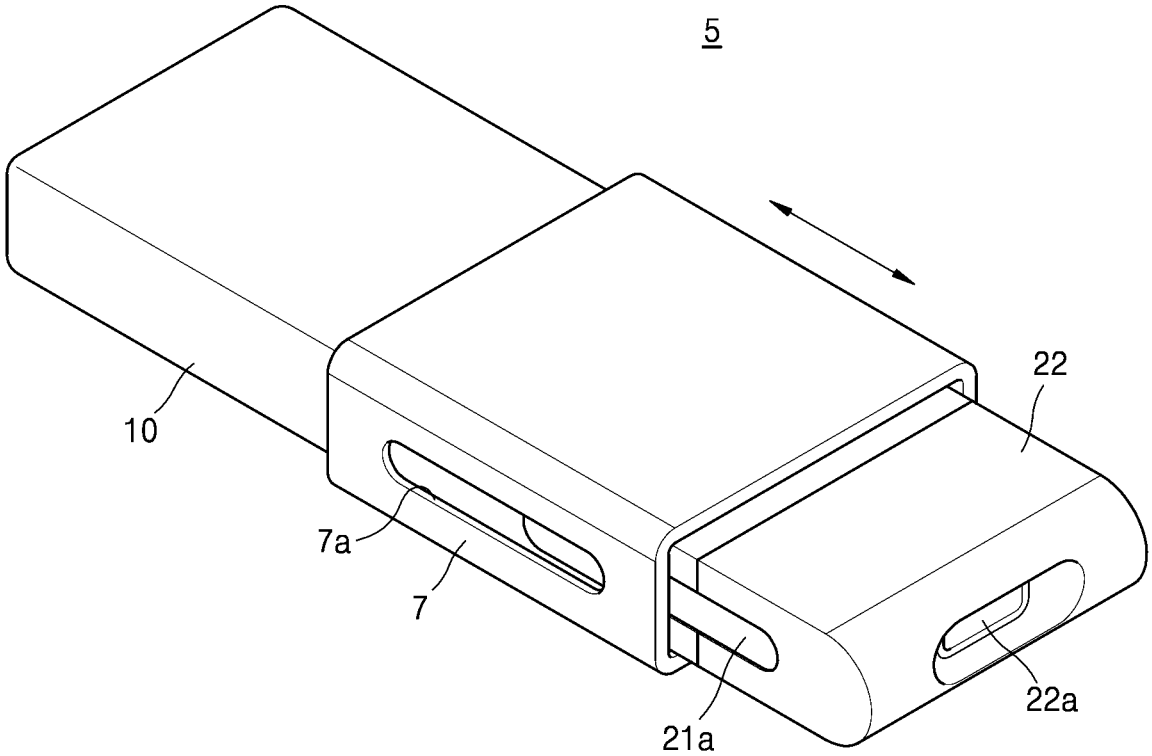
FIG. 3 is a perspective view of another example operating state of the aerosol generating device according to the embodiment illustrated in FIG. 1.

FIG. 3 is a perspective view of another example operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In a state where the slider 7 is moved to the position where the end of the mouthpiece 22 is exposed to the outside, the user may insert the mouthpiece 22 into his or her mouth and absorb aerosol discharged through the discharge hole 22*a* of the mouthpiece 22.

Even when the slider 7 is moved to the position where the end of the mouthpiece 22 is exposed to the outside, the protruding window 21*a* of the cartridge is exposed to the outside through the elongated hole 7*a* of the slider 7, and thus, the user may visually check the remaining amount of aerosol generating material contained in the cartridge.

Figure 4:
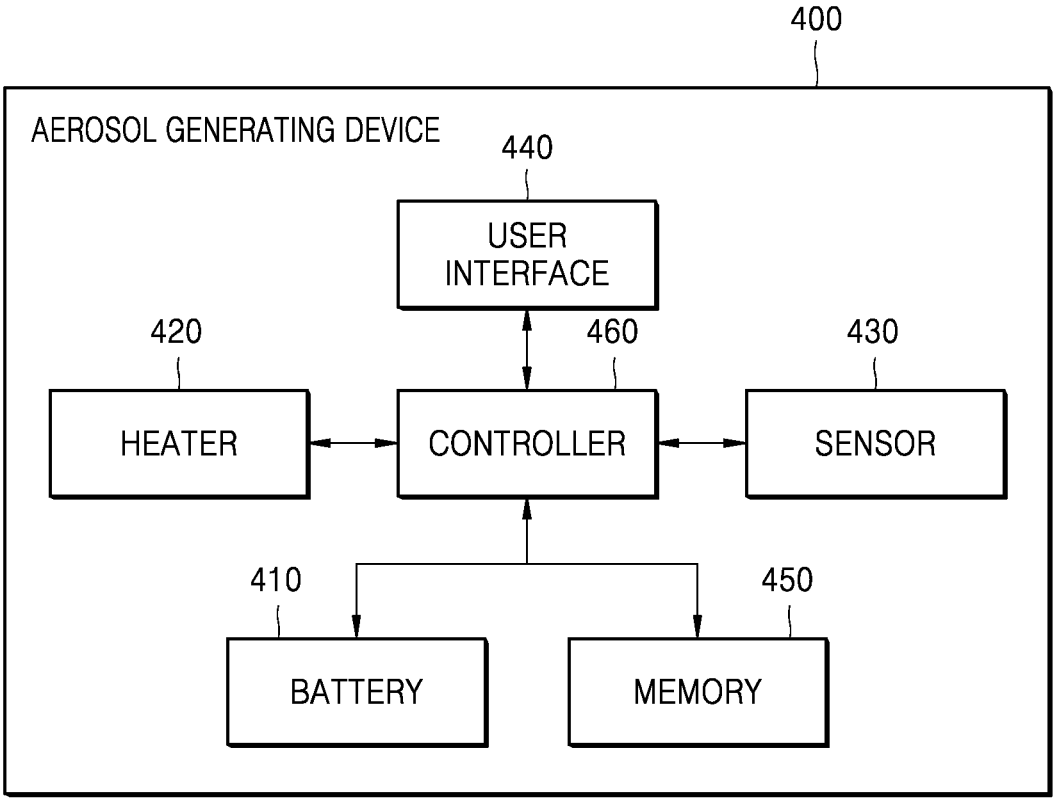
FIG. 4 is a block diagram illustrating hardware components of an aerosol generating device according to an embodiment.

FIG. 4 is a block diagram illustrating hardware components of an aerosol generating device according to an embodiment. The aerosol generating device 400 illustrated in FIG. 4 may correspond to the aerosol generating device 5 described above with reference to FIG. 1.

Referring to FIG. 4, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 4. According to the design of the aerosol generating device 400, it will be understood by one of ordinary skill in the art that some of the components shown in FIG. 4 may be omitted or new components may be added.

In an embodiment, the aerosol generating device 400 may consist of only a main body, in which case components included in the aerosol generating device 400 are located in the main body. In another embodiment, the aerosol generating device 400 may comprise or consist of a main body and a cartridge, in which case components included in the aerosol generating device 400 are located separately in the main body and the cartridge. Alternatively, at least some of components included in the aerosol generating device 400 may be located respectively in the main body and the cartridge.

Hereinafter, an operation of each of the components will be described without being limited to a particular location in the aerosol generating device 400.

The battery 410 supplies power to be used for the aerosol generating device 400 to operate. In other words, the battery 410 may supply power such that the heater 420 may be heated. In addition, the battery 410 may supply power required for operation of other components included in the aerosol generating device 400, that is, the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat an aerosol generating article inserted into the aerosol generating device 400, or heat the cartridge mounted on the aerosol generating device 400.

The heater 420 may be located in the main body of the aerosol generating device 400. Alternatively, when the aerosol generating device 400 comprises or consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, the liquid delivery element, and the liquid storage. The aerosol generating material accommodated in the liquid storage may be moved to the liquid delivery element, and the heater 420 may heat the aerosol generating material absorbed by the liquid delivery element, thereby generating aerosol. For example, the heater 420 may include a material such as nickel chromium and may be wound around or arranged adjacent to the liquid delivery element.

The heater 420 may be an induction heating-type heater. The heater 420 may include an electrically conductive coil for heating an aerosol generating article in an induction heating method, and the aerosol generating article or the cartridge may include a susceptor which may be heated by the induction heater.

The aerosol generating device 400 may include at least one sensor 430. A result sensed by the at least one sensor 430 is transmitted to the controller 460, and the controller 460 may control the aerosol generating device 400 to perform various functions such as controlling the operation of the heater 420, restricting smoking, determining whether an aerosol generating article (or a cartridge) is inserted, and displaying a notification.

For example, the at least one sensor 430 may include a puff sensor. The puff detecting sensor may detect a user's puff based on any one of a temperature change, a flow change, a voltage change, and a pressure change.

In addition, the at least one sensor 430 may include a temperature sensor. The temperature sensor may detect the temperature at which the heater 420 (or an aerosol generating material) is heated. The aerosol generating device 400 may include a separate temperature sensor for sensing a temperature of the heater 420, or the heater 420 itself may serve as a temperature sensor instead of including a separate temperature sensor. Alternatively, a separate temperature sensor may be further included in the aerosol generating device 400 while the heater 420 serves as a temperature sensor.

In addition, the at least one sensor 430 may include a position sensor. The position sensor may detect a change in a position of the slider coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

According to an embodiments, the aerosol generating device 400 may be implemented by selecting only some of the above-described examples of the various described interfacing devices.

The memory 450, as a hardware component configured to store various pieces of data processed in the aerosol generating device 400, may store data processed or to be processed by the controller 460. The memory 450 may include various types of memories, such as random access memory (RAM) (e.g., dynamic random access memory (DRAM), static random access memory (SRAM), etc.), read-only memory (ROM), electrically erasable programmable read-only memory (EEPROM), etc.

The memory 450 may store an operation time of the aerosol generating device 400, the maximum number of puffs, the current number of puffs, at least one temperature profile, data on a user's smoking pattern, etc.

The controller 460 may generally control operations of the aerosol generating device 400. The controller 460 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 460 analyzes a result of the sensing by at least one sensor 430, and controls the processes that are to be performed subsequently.

The controller 460 may control power supplied to the heater 420 so that the operation of the heater 420 is started or terminated, based on the result of the sensing by the at least one sensor 430. In addition, based on the result of the sensing by the at least one sensor 430, the controller 460 may control the amount of power supplied to the heater 420 and the time at which the power is supplied, so that the heater 420 is heated to a predetermined temperature or maintained at an appropriate temperature.

The controller 460 may control the user interface 440 based on the result of the sensing by the at least one sensor 430. For example, when the number of puffs reaches the preset number after counting the number of puffs by using the puff sensor, the controller 460 may notify the user by using at least one of a light emitter, a motor, or a speaker that operation of the aerosol generating device 400 will soon be terminated.

Although not illustrated in FIG. 4, the aerosol generating device 400 may form an aerosol generating system together with an additional cradle. For example, the cradle may be used to charge the battery 410 of the aerosol generating device 400. For example, while the aerosol generating device 400 is accommodated in an accommodation space of the cradle, the aerosol generating device 400 may receive power from a battery of the cradle such that the battery 410 of the aerosol generating device 400 may be charged.

Figure 5:
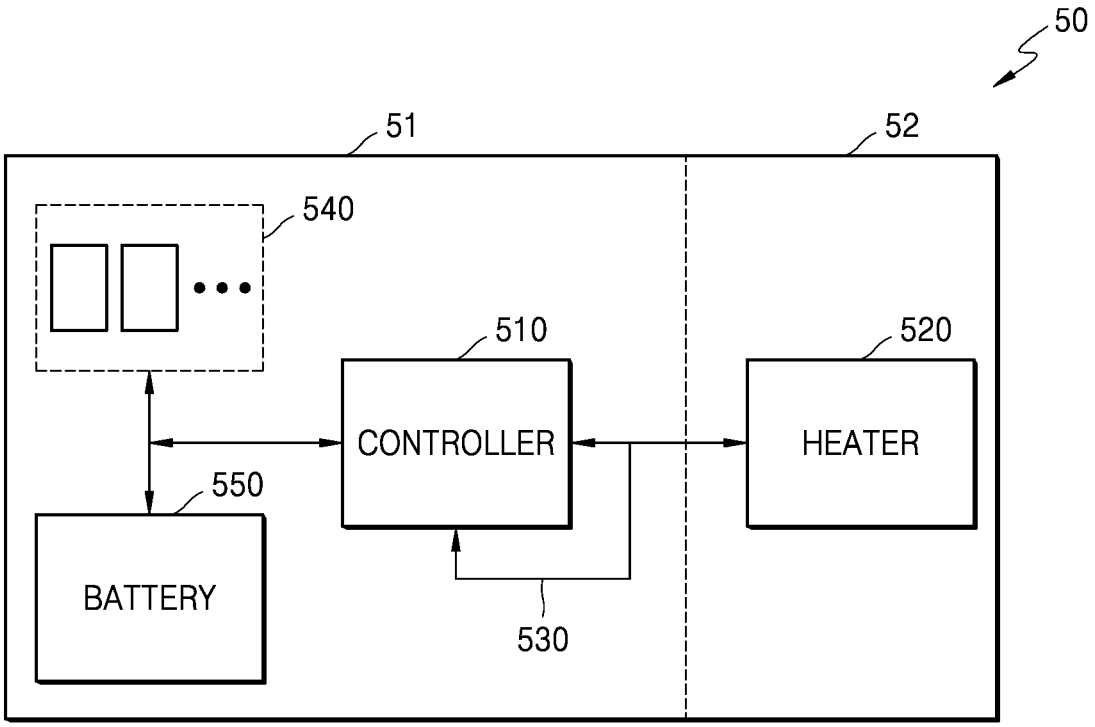
FIG. 5 is a block diagram illustrating the configuration of an aerosol generating device according to an embodiment.

FIG. 5 is a block diagram illustrating the configuration of an aerosol generating device according to an embodiment.

Referring to FIG. 5, an aerosol generating device 50 may include a main body 51 and a cartridge 52. The main body 51 and the cartridge 52 illustrated in FIG. 5 correspond to the main body 10 and the cartridge 20, respectively, which are described with reference to FIGS. 1 through 3 and thus, a redundant description therewith will be omitted. The main body 51 may include a controller 510, a feedback line 530, power consumption components 540, and a battery 550, and the cartridge 52 may include a heater 520. Some components are shown in the main body 51 and the cartridge 52 shown in FIG. 5. However, it can be understood by those of ordinary skill in the art related to embodiments of the present disclosure that components other than the components shown in FIG. 5 may be further included in the main body 51 and the cartridge 52.

The controller 510, the heater 520, and the battery 550 of FIG. 5 correspond to the controller 460, the heater 420, and the battery 410 of FIG. 4, respectively, and thus, a redundant description therewith will be omitted. Also, the power consumption components 540 of FIG. 5 may include at least one of the sensor 430, the user interface 440, and the memory 450 of FIG. 4.

The main body 51 may include an accommodation space in which the cartridge 52 that is detachable is inserted. When the cartridge 52 is inserted into the accommodation space of the main body 51, the main body 51 and the cartridge 52 may be electrically connected to each other.

The battery 550 may be provided in the main body 51 to supply power to the power consumption components 540 included in the main body 51. The battery 550 may also supply power to components included in the cartridge 52 through electrical connection formed between the main body 51 and the cartridge 52. For example, the battery 550 may supply power to the heater 520 inside the cartridge 52.

The feedback line 530 may feedback electrical connection formed between the heater 520 inside the cartridge 52 and the main body 51 as the cartridge 52 is inserted into the accommodation space of the main body 51. For example, when the heater 520 inside the cartridge 52 and the main body 51 are electrically connected to each other, the feedback line 530 may transmit a feedback signal to the controller 510. The feedback line 530 that is a conductor through which electric current passes may include a material having high electrical conductivity. For example, the feedback line 530 may be a conducting wire, but embodiments are not limited thereto. The feedback signal transmitted from the feedback line 530 to the controller 510 may be an electrical signal or current.

When the aerosol generating device 50 is set to a shipping mode, the controller 510 may change a mode of the aerosol generating device 50 to a use mode based on the feedback signal being received through the feedback line 530. The shipping mode may refer to a mode in which hardware components inside the aerosol generating device 50 are deactivated while the aerosol generating device 50 is assembled and shipped and thus the power consumption of the aerosol generating device 50 is minimized. The controller 510 may be programmed so that the aerosol generating device 50 is set to the shipping mode by an external input before the aerosol generating device 50 is shipped.

Also, receiving of the feedback signal through the feedback line 530 may mean that the aerosol generating device 50 is transmitted to the user after the aerosol generating device 50 is shipped and the cartridge 52 is inserted into the accommodation space of the main body 51 so that the user may smoke using the aerosol generating device 50. This is because, in order to smoke using the aerosol generating device 50 used together with the cartridge 52 that is detachable, an operation of inserting the cartridge 52 into the accommodation space of the main body 51 needs to be performed.

In this way, in the aerosol generating device 50 according to an embodiment of the present disclosure, the mode of the aerosol generating device 50 may be changed from the shipping mode to the use mode by detecting that the cartridge 52 is inserted into the accommodation space so that the shipping mode may be released by an operation naturally accompanied in a process of purchasing the aerosol generating device 50 to use. Thus, a cumbersome operation such as connecting a charging cable to an aerosol generating device is not additionally required, as in an aerosol generating device according to the related art, so that user convenience may be increased.

Also, since the aerosol generating device 50 according to the embodiment of the present disclosure is switched to the user mode from the point when the cartridge 52 is inserted into the accommodation space, the power consumption of the battery 550 may be minimized regardless of how long a delay is between the time the aerosol generating device 50 is removed from a packaging and a time the aerosol generating device 50 is actually used by the user. Also, since the aerosol generating device 50 according to the embodiment of the present disclosure uses the feedback line 530 without using a separate sensor to detect that the cartridge 52 is inserted into the accommodation space, power consumed to detect the cartridge 52 may also be reduced.

Also, the controller 510 may apply an enable signal to at least one low-dropout regulator (LDO) (not shown) that controls the supply of a voltage or current with respect to the power consumption components 540, thereby changing the mode of the aerosol generating device 50 to the use mode. The LDO may refer to hardware that provides the regulated voltage/current to the power consumption components 540 using power transmitted from the battery 550. Hereinafter, a process in which the aerosol generating device 50 changes the mode of the aerosol generating device 50 using at least one LDO, will be described in detail with reference to FIG. 6.

Figure 6:
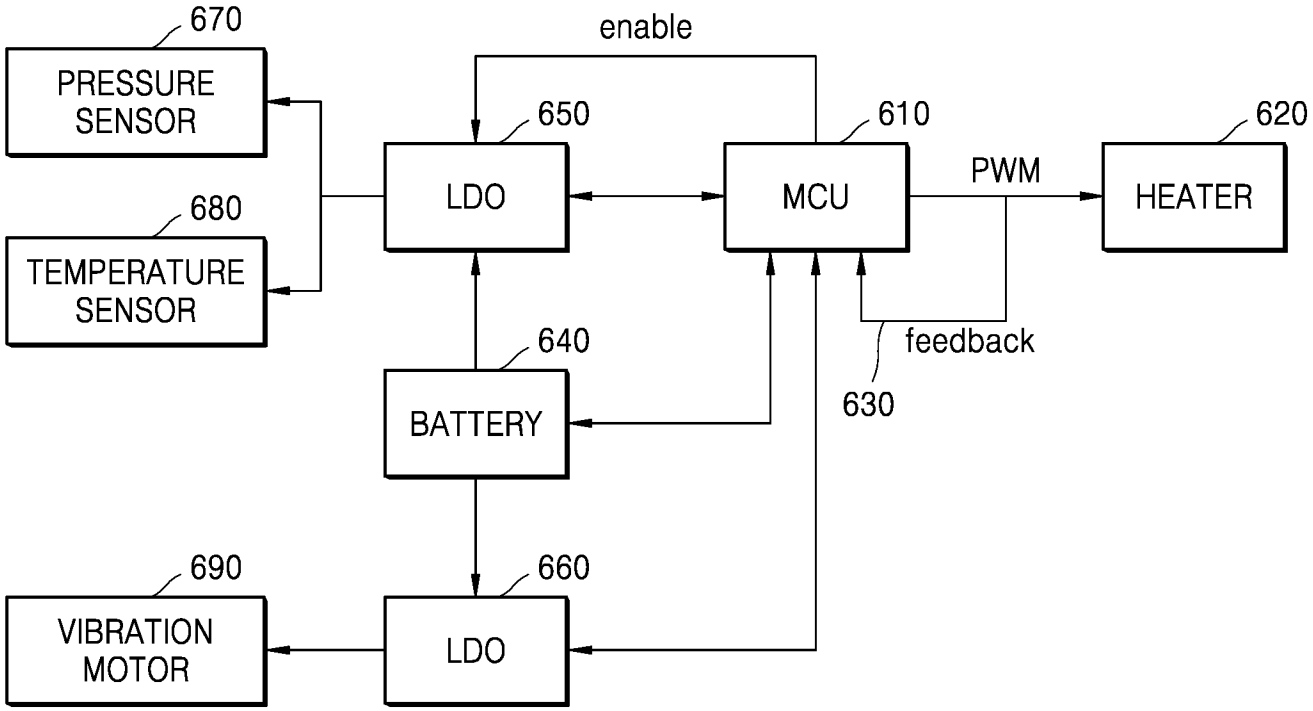
FIG. 6 is a view illustrating an example of a circuit structure inside an aerosol generating device according to an embodiment.

FIG. 6 is a view showing an example of a circuit structure inside an aerosol generating device according to an embodiment.

A micro controller unit (MCU) 610 of FIG. 6 may be a dedicated processor for controlling an aerosol generating device, and may correspond to the controller 460 of FIG. 4 or the controller 510 of FIG. 5. Also, a heater 620 of FIG. 6 may correspond to the heater 420 of FIG. 4 or the heater 520 of FIG. 5, and a feedback line 630 of FIG. 6 may correspond to the feedback line 530 of FIG. 5. A battery 640 of FIG. 6 may correspond to the battery 410 of FIG. 4 or the battery 550 of FIG. 5. Thus, a redundant description with the above-described components will be omitted.

The MCU 610 may be programmed to operate first in the shipping mode. When the aerosol generating device is in the shipping mode, the MCU 610 may not apply an enable signal to an LDO 650 and an LDO 660. Thus, the LDO 650 and the LDO 660 may be disabled and may block electrical connection between the power consumption components each connected to one of the LDO 650 and the LDO 660 and the battery 640. The power consumption components connected to each of the LDO 650 and the LDO 660 may be deactivated as electrical connection between the power consumption components and the battery 640 is blocked. Thus, power consumption caused by the power consumption components may be prevented.

For example, the LDO 650 may block electrical connection between a pressure sensor 670 and a temperature sensor 680, connected to the LDO 650, and the battery 640, thereby deactivating the pressure sensor 670 and the temperature sensor 680. Also, the LDO 660 may block electrical connection between a vibration motor 690, connected to the LDO 660, and the battery 640, thereby deactivating the vibration motor 690. Thus, the power consumption of the battery 640 may be minimized after the aerosol generating device is shipped and is sold to the user before being used, and a stocked time at a shipping destination (e.g. a store) when the aerosol generating device may be sold to the user may be increased.

Also, after the aerosol generating device is shipped (e.g. to a store), it may be purchased from the user, and the user may insert the cartridge into a main body of the aerosol generating device to smoke using the aerosol generating device. Thus, electrical connection between the MCU 610 in the main body and the heater 620 in the cartridge may be formed. For example, the MCU 610 may receive a feedback signal through the feedback line 630 based on the electrical connection between the MCU 610 and the heater 620 being formed. When the feedback signal is received through the feedback line 630, the MCU 610 may apply an enable signal to the LDO 650 and the LDO 660.

As the LDO 650 and the LDO 660 are enabled according to the enable signal from the MCU 610, they may electrically connect the power consumption components, connected to each of the LDO 650 and the LDO 660, to the battery 640. The power consumption components connected to each of the LDO 650 and the LDO 660 may be activated as electrical connection between the power consumption components and the battery 640 is provided.

For example, the LDO 650 may electrically connect the pressure sensor 670 and the temperature sensor 680 to the battery 640, thereby activating the pressure sensor 670 and the temperature sensor 680. Also, the LDO 660 may electrically connect the vibration motor 690 to the battery 640, thereby activating the vibration motor 690. Thus, the pressure sensor 670, the temperature sensor 680, and the vibration motor 690, which are power consumption components in the aerosol generating device, may respond to external input quickly to perform operations required for the user to smoke.

Also, for convenience of description, FIG. 6 describes an example in which two LDOs are included in the aerosol generating device. However, it will be easily understood by those skilled in the art that more or less than two LDOs may be included in the aerosol generating device, and the type of the power consumption components connected to each of the LDOs may be different from the example described with respect to FIG. 6.

Referring back to FIG. 5, when the aerosol generating device 50 is in the shipping mode, at least one LDO may block electrical connection between the power consumption components 540, connected to the at least one LDO, and the battery 550, thereby deactivating the power consumption components 540. Also, when the aerosol generating device 50 in the use mode, at least one LDO may electrically connect the power consumption components 540, connected to the at least one LDO, to the battery 550, thereby activating the power consumption components 540.

Also, after the aerosol generating device 50 is changed to the use mode, the controller 510 may maintain the mode of the aerosol generating device 50 as the use mode even if a feedback signal is not received through the feedback line 530. In other words, once the aerosol generating device 50 is switched from the shipping mode to the use mode, the controller 510 may maintain the use mode regardless of whether the feedback signal is received unless separate programming is performed.

However, when the aerosol generating device 50 is in the use mode, the presence or absence of the feedback signal through the feedback line 530 may be utilized to perform additional control of the aerosol generating device 50 or to increase user convenience. For example, when the aerosol generating device 50 is in the use mode, the controller 510 may display information on the remaining amount of the battery 550 based on the feedback signal being not received through the feedback line 530 and then being received again. Not receiving of the feedback signal through the feedback line 530 may mean that the cartridge 52 is separated from the main body 51, and receiving of the feedback signal through the feedback line 530 again may mean that the cartridge 52 or a new cartridge is coupled to the main body 51.

In this way, when the user couples the cartridge 52 or the new cartridge to the main body 51, the aerosol generating device 50 may predict the user's use intention and may provide relevant information to the user in response thereto. Also, the information on the remaining amount of the battery 550 is just an example, and when the feedback signal is received through the feedback line 530 again, the controller 510 may provide information on the type or remaining amount of the cartridge 52 inserted into the main body 51 or information related to the state of each component included in the aerosol generating device 50. Also, a method in which the controller 510 provides information to the user is not limited to a method of using a display and may be a method of using a motor, a speaker, or other output interfacing units.

Also, the use mode may include a sleep mode in which at least some of the power consumption components 540 are maintained in an activated state, and an operation mode in which a preset operation is performed using at least some of the power consumption components 540 or the heater 520. Power consumption in the sleep mode is slightly higher than that in the shipping mode. However, due to activation of the power consumption components 540, the sleep mode may correspond to a mode having high reactivity with respect to an external input. The operation mode may include a preheating mode and a heating mode. In an example, the controller 510 may set the mode of the heater 520 to the preheating mode to start the operation of the heater 520 after receiving the user's input for the aerosol generating device 50. Also, the controller 510 may switch the mode of the heater 520 from the preheating mode to the heating mode after detecting the user's puff using a puff sensor.

Figure 7:
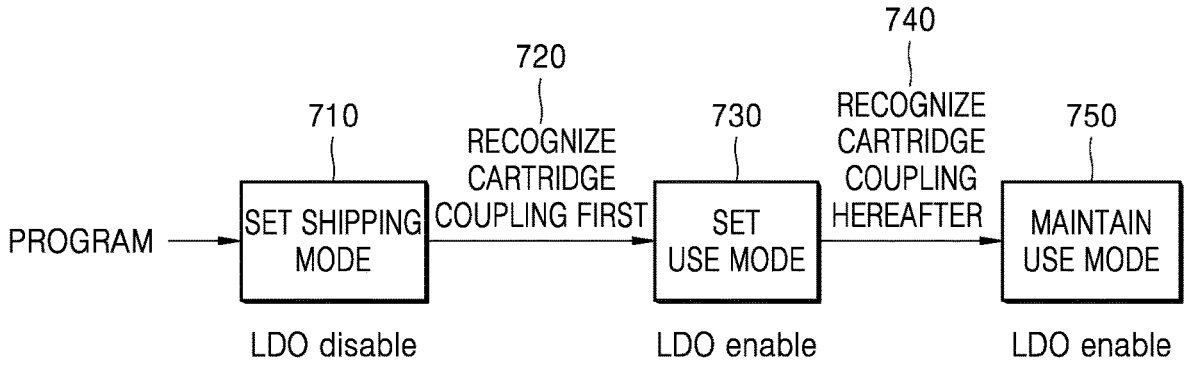
FIG. 7 is a view for describing a control algorithm of a micro controller unit (MCU) according to an embodiment.

FIG. 7 is a view for describing a control algorithm of an MCU according to an embodiment.

Referring to FIG. 7, the control algorithm of the MCU included in an aerosol generating device according to an embodiment of the present disclosure is shown. Since the MCU may correspond to the controller 460 of FIG. 4, the controller 510 of FIG. 5, or the MCU 610 of FIG. 6, a redundant description thereof will be omitted.

The MCU may be set to the shipping mode through programming before the aerosol generating device is shipped (710). When the MCU is set to the shipping mode (710), the LDO is disabled, so that electrical connection between power consumption components in the aerosol generating device and the battery may be blocked. When electrical connection between the power consumption components and the battery is blocked, the power consumption components may be deactivated. Thus, the power consumption of the battery may be minimized.

Also, when cartridge coupling is first recognized after the MCU is set to the shipping mode (720), the MCU may be changed to the use mode (730). When the MCU is changed to the use mode (730), the LDO is enabled, so that the power consumption components in the aerosol generating device and the battery may be electrically connected to each other. When the power consumption components and the battery are electrically connected to each other, the power consumption components may be activated. Thus, the power consumption components may have reactivity.

When cartridge coupling is recognized again after the MCU is changed to the use mode (740), the MCU may be maintained in the use mode (750). Since the use mode includes a sleep mode and an operation mode, the MCU may operate in one of the sleep mode and the operation mode. In both the sleep mode and the operation mode, the LDO may be in an enabled state. Also, when cartridge coupling is recognized in a state in which the MCU is in the use mode (740), information on at least some of components of the aerosol generating device may be provided to the user.

Figure 8:
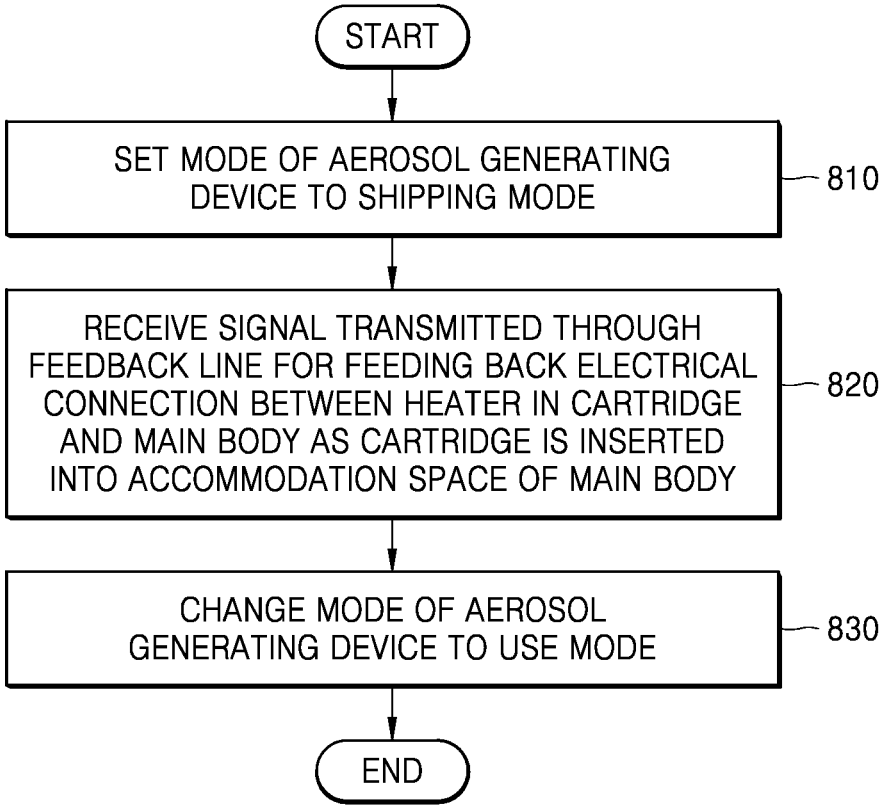
FIG. 8 is a flowchart illustrating an operating method of an aerosol generating device according to an embodiment.

FIG. 8 is a flowchart illustrating an operating method of an aerosol generating device according to an embodiment.

Referring to FIG. 8, the operating method of the aerosol generating device may include operations to be processed in time series by the aerosol generating device 5, the aerosol generating device 400, or the aerosol generating device 50, which are shown in FIGS. 1 through 6. Thus, even if omitted below, the aerosol generating device 5, the aerosol generating device 400, or the aerosol generating device 50 of FIGS. 1 through 6 may perform the operating method described with respect to FIG. 8.

In Operation 810, the aerosol generating device may set the mode of the aerosol generating device to a shipping mode. As the aerosol generating device is programmed by an external input while being shipped before it is sold to the user, the aerosol generating device may be set to the shipping mode.

In Operation 820, as a cartridge is coupled to an accommodation space of a main body, the aerosol generating device may receive a signal transmitted through a feedback line for feeding back electrical connection between a heater, in the cartridge, and the main body. Receiving of the signal through the feedback line may mean that the aerosol generating device is obtained by the user (e.g., sold to the user) after the aerosol generating device is shipped and the cartridge is inserted into the accommodation space of the main body so that the user may smoke using the aerosol generating device.

In Operation 830, the aerosol generating device may change the mode of the aerosol generating device to the use mode. As the aerosol generating device detects that the cartridge is inserted into the accommodation space of the main body so that the user may smoke using the aerosol generating device, the aerosol generating device may change the mode of the aerosol generating device to the use mode. In this way, the aerosol generating device according to an embodiment of the present disclosure may maintain the shipping mode until the user actually smokes using the aerosol generating device after is the aerosol generating device is shipped. Thus, power consumption may be minimized. Also, since the aerosol generating device according to an embodiment of the present disclosure uses a feedback line without using a separate sensor to detect that the cartridge is inserted into the accommodation space of the main body, power consumed to detect the cartridge being inserted into the accommodation space may also be reduced.

One embodiment may also be implemented in the form of a recording medium including instructions executable by a computer, such as a program module executable by the computer. A computer-readable medium may be any available medium that can be accessed by a computer and includes both volatile and nonvolatile media, and removable and non-removable media. In addition, the computer-readable medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

The above-described embodiments are merely example embodiments of the present disclosure, and it will be understood by one of ordinary skill in the art that various changes and equivalents thereof may be made.

What is claimed is:

1. An aerosol generating device comprising:

a main body comprising an accommodation space into which a cartridge, that is detachable, is configured to be inserted;

a battery provided in the main body and configured to supply power to at least one power consumption component included in the main body;

at least one low-dropout regulator (LDO) configured to block electrical connection between the at least one power consumption component and the battery when the aerosol generating device is in a shipping mode;

a feedback line configured to transmit a feedback signal based on the cartridge being inserted into the accommodation space and an electrical connection between a heater in the cartridge and the main body being formed; and a controller configured to, in response to receiving the feedback signal through the feedback line, change a mode of the aerosol generating device from the shipping mode to a use mode and apply an enable signal to the at least one LDO such that the at least one LDO electrically connects the at least one power consumption component to the battery.

2. The aerosol generating device of claim 1, wherein the controller is further configured to maintain the mode of the aerosol generating device as the use mode even if the feedback signal is not received through the feedback line after the aerosol generating device is changed to the use mode.

3. The aerosol generating device of claim 1, wherein the controller is further configured to cause display of information on a remaining amount of the battery based on, after the mode of the aerosol generating device is changed from the shipping mode to the use mode, the feedback signal not being received through the feedback line due to the cartridge being removed from the accommodation space and the feedback signal being received again due to the cartridge being re-inserted into the accommodation space or a new cartridge being inserted into the accommodation space.

4. The aerosol generating device of claim 1, wherein the use mode comprises a sleep mode in which at least some of the at least one power consumption component are maintained in an activated state, and an operation mode in which a preset operation is performed using one or more of the at least one power consumption component or the heater.

5. The aerosol generating device of claim 1, wherein the at least one power consumption component comprises at least one from among a sensor, a user interface, and a memory.

6. The aerosol generating device of claim 1, wherein the controller is further configured to set the aerosol generating device to the shipping mode based on an external input before the aerosol generating device is shipped.

* * * * *